United States Patent [19]

Nunez et al.

[11] 4,175,778

[45] Nov. 27, 1979

[54] RELEASING TOOL

[75] Inventors: Carl W. Nunez; Joseph S. Squyres, both of Lafayette, La.

[73] Assignee: Halliburton Company, Duncan, Okla.

[21] Appl. No.: 901,397

[22] Filed: May 1, 1978

[51] Int. Cl.[2] ..... E21B 23/00; F16L 37/14

[52] U.S. Cl. ..... 285/3; 166/125; 285/18

[58] Field of Search ..... 285/3, 18, 39, 4; 166/318, 125

[56] References Cited

U.S. PATENT DOCUMENTS

| | | | |
|---|---|---|---|
| 2,315,931 | 4/1943 | Burt et al. | 166/125 X |
| 2,409,811 | 10/1946 | Taylor, Jr. et al. | 166/125 |
| 2,843,399 | 7/1958 | Arterbury et al. | 285/3 |
| 2,980,185 | 4/1961 | Daffin | 166/125 X |
| 3,037,797 | 6/1962 | Brown | 285/18 |
| 3,051,244 | 8/1962 | Litchfield | 285/18 X |
| 3,148,894 | 9/1964 | Schwab | 285/3 |
| 3,827,258 | 8/1974 | Kammerer, Jr. et al. | 285/18 X |
| 4,018,284 | 4/1977 | Perkins | 166/318 X |
| 4,089,548 | 5/1978 | Gurley | 285/3 |

*Primary Examiner*—Thomas F. Callaghan

*Attorney, Agent, or Firm*—John H. Tregoning; James R. Duzan

[57] ABSTRACT

A releasing tool for use in gravel packing operations comprising case means for releasably attaching the releasing tool to a tubing string, releasing block means retained within the case means for releasably attaching the releasing tool to the hook-up nipple of a gravel pack screen assembly and releasing mandrel means slidably disposed within the case means for alternately allowing the releasing block means to engage and disengage the hook-up nipple of a gravel pack screen assembly.

1 Claim, 2 Drawing Figures

RELEASING TOOL

This invention relates to a tool for use in gravel packing wells. More specifically, this invention relates to a tool for the retention and release of a gravel pack screen assembly when gravel packing wells.

In wells in geological formations where the production of sand from the formation along with the liquids and gases being produced therefrom is a problem, it is well known in the art to install a screen in the production tubing and pack gravel around the screen to prevent the sand from the formation flowing into the production tubing. In such an arrangement, a gravel pack screen assembly is run into the formation on a string of tubing to the desired location and gravel, typically course sand mixed in a gelled liquid, is pumped down to the exterior of the gravel pack screen assembly to fill the area between the screen assembly and the formation. After a sufficient amount of gravel has been pumped down to the exterior of the gravel pack screen assembly to completely fill the area between the screen assembly and the formation, the screen assembly is released from the tubing string and the tubing removed from the well with production tubing subsequently being installed in the well.

Typical prior art tools used to retain and subsequently release gravel pack screen assemblies have required the rotation of the tubing string to release the tool and tubing attached thereto from the gravel pack screen assembly. If rotation of the tubing is required to release the tool and tubing string from the gravel pack screen assembly, this means that equipment capable of rotating the tubing string must be provided at the well.

In contrast to the prior art, the present invention comprises a tool for the retention and release of a gravel pack screen assembly in gravel packing operations in wells which can be actuated without rotation of the tubing string.

The present invention is a simple, inexpensive, easily manufactured pressure actuated tool comprising a case, sliding releasing mandrel and locking blocks which releasably engage the gravel pack screen assembly.

The foregoing advantages and the preferred embodiment of the present invention will be better understood from the following specification taken in conjunction with the accompanying drawings wherein.

Figure 1:
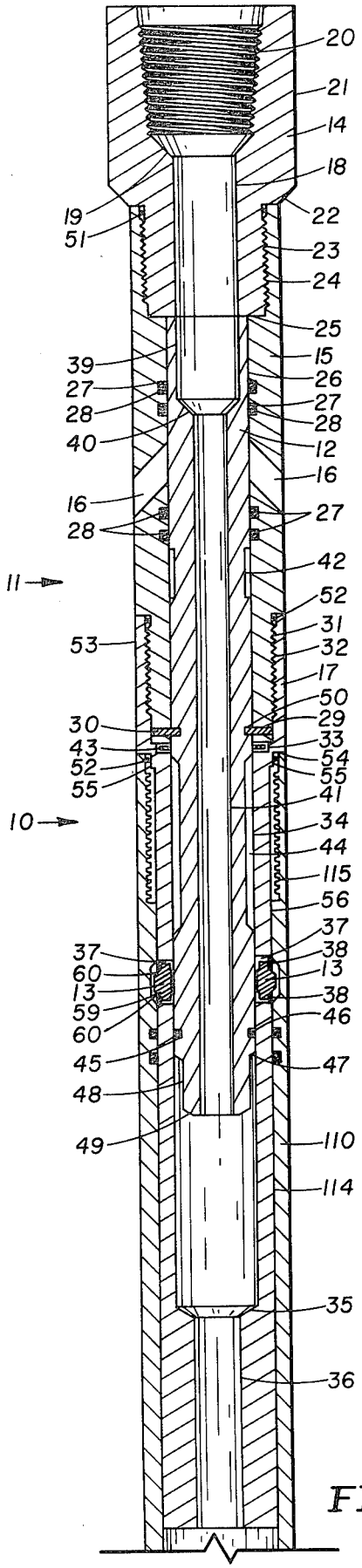
FIG. 1 is a cross-sectional view of the present invention engaging the hook-up nipple of a gravel pack screen assembly.

Referring to FIG. 1, the present invention is shown in its preferred embodiment.

The releasing tool 10 comprises a case 11, releasing mandrel 12 and releasing blocks 13.

The case 11 comprises an adapter member 14 for securing the releasing tool 10 to a tubing string, ported case 15 having a plurality of fluid ports 16 therein and releasing body 17 which contains a plurality of the releasing blocks 13 therein.

The adapter member 14 comprises a cylindrical member having a first bore 18, chamfered surface 19, threaded bore 20, first cylindrical surface 21, conical surface 22 and threaded cylindrical surface 23 which engages threaded bore 24 of the ported case 15.

The ported case 15 comprises a cylindrical member having threaded bore 24, annular shoulder 25, bore 26 having seal cavities 27 containing sealing means 28 therein and having a plurality of ports 16 therein and in the lower end of the case 15 a plurality of apertures 29 having shear pins 30 contained therein. The lower exterior surface of the ported case 15 contains a threaded portion 31 which mates with threaded bore 32 of releasing body 17 and an annular shoulder.

The releasing body 17 comprises a cylindrical member having a threaded bore 32, annular cavity 33, first bore 34, chamfered surface 35 and second bore 36. The intermediate portion of the releasing body 17 contains a plurality of apertures 37 which contain the releasing blocks 13 therein. Thin annular bands 38 overlie portions of the apertures 37 to retain the releasing blocks 13 in the apertures 37 when the releasing tool 10 is not engaged with a gravel pack screen assembly. The annular bands 38 are secured to the releasing body 17 by any suitable means, such as welding. The exterior of releasing body 17 comprises a first cylindrical portion 53, annular shoulder 54 which abuts annular surface 113 of hook-up nipple 110 of a gravel pack screen assembly when releasing tool 10 is installed therein, second cylindrical surface 55 which receives seal means 51 thereon, and third cylindrical surface 56 which mates with bore 114 of the hook-up nipple 110 of a gravel pack screen assembly.

The releasing mandrel 12 comprises a cylindrical member having a first bore 39 which is the same diameter as bore 18 of the adapter member 14, chamfered surface 40, and second bore 41. The exterior surface of the releasing mandrel 12 is formed having an annular channel 42 which receives a locking ring 43 therein when the releasing tool has been actuated, annular channel 44 which receives locking blocks 13 therein when the releasing tool 10 has been actuated, annular seal cavity 45 having seal means 46 located therein, chamfered surface 47, a reduced diameter cylindrical surface 48 and chamfered surface 49 located on the end of the releasing mandrel 12 which mates with chamfered surface 35 of releasing body 17. The releasing mandrel 12 further includes a plurality of apertures 50 which receive a portion of the shear pins 30 that extend into the releasing mandrel 12.

When assembled, suitable sealing means 51 and 52, such as an elastomeric O-ring type seal, are installed between the adapter member 14 on threaded cylindrical surface 23 thereof and ported case 15, between ported case 15 and releasing body 17, and between releasing body 17 on second cylindrical surface 55 thereof and threaded portion 115 of hook-up nipple 110 respectively.

In this connection, the sealing means 28 and 46 can be any suitable type, such as an elastomeric O-ring type seal.

Releasing blocks 13 are each formed with a portion 59 having chamfered surfaces 60 thereon protruding from apertures 37 in the releasing body 17. As shown, the releasing blocks 13 are formed having portions 59 thereof smaller than the annular channel 111 of the hook-up nipple 110. This allows threaded portion 115 of the hook-up nipple to disengage from seal means 52 when being run into the well thereby allowing any trapped fluids or gases to be vented from the hook-up nipple 110 and gravel pack screen assembly. Upon seating in the well, the threaded portion 115 re-engages seal means 52 thereby sealing the interior of the releasing tool 10 and hook-up nipple 110 from the exterior thereof.

Figure 2:
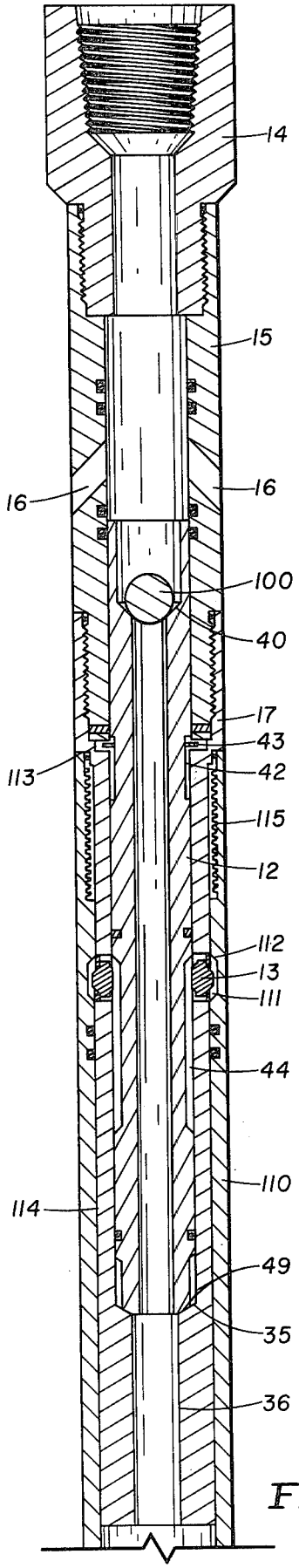
FIG. 2 is a cross-sectional view of the present invention after the tool has been actuated to release from the hook-up nipple of a gravel pack screen assembly but before the tool has been withdrawn therefrom.

Referring to FIG. 2, the releasing tool 10 is shown after the releasing mandrel 12 has been actuated.

To actuate the releasing mandrel 12 a ball 100 is inserted in the tubing string attached to adpater member 14 and either is allowed to free-fall or is pumped down the tubing string until the ball rests upon chamfered surface 40 of releasing mandrel 12. When the ball 100 is seated on the chamfered surface 40 of releasing mandrel 12, the fluid pressure in the tubing string is increased until the force applied to the releasing mandrel 12 is great enough to shear pins 30 retaining the releasing mandrel 12 in its upper most position. When shear pins 30 have been sheared, the releasing mandrel 12 moves downwardly in bore 26 of ported case 15 and bore 34 of releasing body 17 until, as illustrated, chamfered surface 49 on the end of releasing mandrel 12 rests on chamfered surface 35 of releasing body 17.

When in this position, snap ring 43 engages annular channel 42 of releasing mandrel 12 and releasing blocks 13 are free to move into annular channel 44 of releasing mandrel 12. Also, any flow through releasing mandrel 12 is blocked by ball 100 sealingly engaging chamfered surface 40 of the releasing mandrel 12, and since the releasing mandrel 12 is in its lower most position in the releasing tool 10 thereby uncovering ports 16 in ported case 15, any fluid flow down the tubing string attached to adapter member 14 will be directed through bores 18 and 26 of the releasing tool 10 and out ports 16 in ported case 15. It should be noted that since the fluid pressure is greater on the interior of the tool than on the exterior thereof, the releasing tool 10 will be maintained in engagement with hook-up nipple 110 of the gravel pack screen assembly (not shown).

When the releasing tool 10 is withdrawn from the hook-up nipple 110 of the gravel pack screen assembly after the releasing mandrel 12 of the releasing tool 10 has been actuated, the releasing blocks 13 are cammed inwardly into annular channel 44 of the releasing mandrel 12 by the conical surface 112 of the annular channel 111 of the hook-up nipple 110 thereby allowing the releasing tool 10 to be withdrawn from the hook-up nipple 110.

Since snap ring 43 engages annular channel 42 of the releasing mandrel 12 of the releasing tool 10, once actuated, the releasing mandrel 12 is prevented from returning to its original position until the snap ring 43 is disengaged from annular channel 42. To disengage snap ring 43 from annular channel 42 the ported case 15 is disengaged from releasing body 17 by unthreading threaded portion 31 of ported case 15 from threaded bore 32 of the releasing body 17.

At this time, when disassembled, the snap ring 43 can be expanded to disengage it from annular channel 42 of the releasing mandrel 12 and returned to a position slightly above annular channel 44 on release mandrel 12 while the portions of shear pins 30 remaining in bores 29 and 50 of the ported case 15 and releasing mandrel 12 can be removed. Subsequently, the releasing mandrel 12 can be moved to its upper most position in ported case 15 and new shear pins 30 installed in bores 29 and 50 of the ported case 15 and releasing mandrel 12 to retain the releasing mandrel 12 thereat.

The ported case 15 can then be rethreaded into engagement with releasing body 17 thereby readying releasing tool 10 for operation. It should be noted that during disassembly of the releasing tool 10, annular bands 38 retain the releasing blocks 13 within the releasing body 17.

Having thus described my invention, I claim:

1. A releasing tool having one end thereof being adapted to be releasably attached to a hook-up nipple having a bore therethrough of a gravel pack screen assembly while having the other end thereof adapted to be releasably attached to a tubing string, said releasing tool comprising:

case means for releasably attaching said releasing tool to said tubing string, said case means including:

adapter means having a bore therethrough for releasably attaching said releasing tool to said tubing string;

ported case means having a bore therethrough, having a plurality of ports therein for communicating the bore of said ported case means with the exterior of said ported case means and having annular seal means disposed in the wall of the bore through said ported case means on opposite sides of said ports; and releasing body means having a bore therethrough and a plurality of apertures therein;

releasing block means retained within the apertures in said releasing body means of said case means for releasably attaching said releasing tool to said hook-up nipple of said gravel pack screen assembly;

releasing mandrel means slidably disposed within said case means for alternately allowing said releasing block means to engage and disengage an annual channel in said hook-up nipple of said gravel pack screen assembly when said releasing mandrel means is moved from a first position in said case means maintaining said releasing block means engaging said hook-up nipple to a second position in said case means allowing said releasing block means to disengage said hook-up nipple, said releasing mandrel means including:

a cylindrical member slidably disposed within said case means, said cylindrical member having a bore therethrough, a first annular channel in the exterior surface thereof, and a second annular channel in the exterior surface thereof for receiving said releasing block means therein when said releasing mandrel means is in said second position allowing said releasing block means to disengage said hook-up nipple;

shear pin means securing said ported case means to said releasing mandrel means thereby maintaining said releasing mandrel means in said first position in said case means; and snap ring means retained in an annular cavity formed when a portion of one end of said ported case means abuts a portion of one end of said releasing body means, said snap ring means engaging the first annular channel in said releasing mandrel means when said releasing mandrel means is in said second position thereby retaining said releasing mandrel means in said second position.

* * * * *